US012569004B2

(12) United States Patent
Cox et al.

(10) Patent No.: US 12,569,004 B2
(45) Date of Patent: Mar. 10, 2026

(54) AEROSOL DELIVERY DEVICE WITH SEPARABLE HEAT SOURCE AND SUBSTRATE

(71) Applicant: R.J. Reynolds Tobacco Company, Winston-Salem, NC (US)

(72) Inventors: Keri Meggan Cox, Pleasant Garden, NC (US); Edmond Strother Smith, III, Rural Hall, NC (US); Zachary Kevin Francis, Winston-Salem, NC (US); Thaddeus Jackson, Summerfield, NC (US); Billy T Conner, Clemmons, SC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 1998 days.

(21) Appl. No.: 16/516,932

(22) Filed: Jul. 19, 2019

(65) Prior Publication Data

US 2021/0015177 A1 Jan. 21, 2021

(51) Int. Cl.
*A24D 1/22* (2020.01)

(52) U.S. Cl.
CPC ..... *A24D 1/22* (2020.01)

(58) Field of Classification Search
CPC ..... A24D 1/22
See application file for complete search history.

(56) References Cited

U.S. PATENT DOCUMENTS 1,464,300 A 8/1923 Taff
1,505,655 A 8/1924 Marek
1,541,891 A 6/1925 Becker
1,607,132 A 11/1926 Shichigoro
1,613,545 A 1/1927 Teigen
1,941,531 A 1/1934 Blankenship
2,008,433 A 7/1935 Ashour
2,373,629 A 4/1945 Daugherty
(Continued)

FOREIGN PATENT DOCUMENTS

JP 2002034543 A 2/2002
RU 2450780 C2 5/2012
(Continued)

OTHER PUBLICATIONS

International Search Report from the corresponding International Application No. PCT/IB2020/056770, mailed Oct. 2, 2020.
(Continued)

*Primary Examiner* — Michael H. Wilson
*Assistant Examiner* — Jennifer A Kessie
(74) *Attorney, Agent, or Firm* — Womble Bond Dickinson (US) LLP

(57) ABSTRACT

The present disclosure is directed to an aerosol delivery device. In some implementations, the aerosol delivery device may comprise a holder, a heat portion including a heat source configured to generate heat, and a substrate portion comprising a substrate material including an aerosol precursor composition. The holder may be configured to receive the heat portion and the substrate portion, the heat portion and the substrate portion may be disposed proximate each other, and the heat portion and the substrate portion may be separate components and may be configured to be independently removable and replaceable within the holder.

15 Claims, 10 Drawing Sheets

(56) References Cited

U.S. PATENT DOCUMENTS

| | | | |
|---|---|---|---|
| 2,455,492 | A | 12/1948 | Jackson |
| 2,502,831 | A | 4/1950 | Henry |
| 2,541,837 | A | 2/1951 | Joseph |
| 2,701,571 | A | 2/1955 | Dittrich |
| 2,711,176 | A | 6/1955 | Randey |
| 2,779,340 | A | 1/1957 | Lee |
| 2,953,136 | A | 9/1960 | Dahly |
| 3,155,099 | A | 11/1964 | Minchin |
| 3,181,538 | A | 5/1965 | Mario |
| 3,685,520 | A | 8/1972 | Chernack |
| 4,708,151 | A | 11/1987 | Shelar |
| 4,714,082 | A | 12/1987 | Banerjee et al. |
| 4,966,171 | A | 10/1990 | Serrano et al. |
| 4,991,606 | A | 2/1991 | Serrano et al. |
| 5,040,552 | A | 8/1991 | Schleich et al. |
| 5,060,676 | A | 10/1991 | Hearn et al. |
| 5,076,296 | A | 12/1991 | Nystrom et al. |
| 5,159,940 | A | 11/1992 | Hayward et al. |
| 5,178,165 | A | 1/1993 | DeFelice |
| 5,240,012 | A | 8/1993 | Ehrman et al. |
| 5,592,955 | A | 1/1997 | Keritsis |
| 5,595,577 | A | 1/1997 | Bensalem et al. |
| 5,692,525 | A | 12/1997 | Counts et al. |
| 5,845,649 | A | 12/1998 | Saito et al. |
| 6,006,757 | A | 12/1999 | Lichtenberg |
| 6,053,176 | A | 4/2000 | Adams et al. |
| 6,164,287 | A | 12/2000 | White |
| 6,311,694 | B1 | 11/2001 | Nichols et al. |
| 6,345,625 | B1 | 2/2002 | Chew |
| 6,371,127 | B1 | 4/2002 | Snaidr et al. |
| 6,431,177 | B1 | 8/2002 | Sieggen et al. |
| 6,532,965 | B1 | 3/2003 | Abhulimen et al. |
| 6,615,843 | B2 | 9/2003 | Pera |
| 6,748,955 | B2 | 6/2004 | Snaidr et al. |
| 7,080,649 | B2 | 7/2006 | Hcu |
| 7,503,330 | B2 | 3/2009 | Borschke et al. |
| 7,600,517 | B1 | 10/2009 | Holzrichter |
| 7,624,739 | B2 | 12/2009 | Snaidr et al. |
| 8,061,361 | B2 | 11/2011 | Maeder et al. |
| 8,151,803 | B2 | 4/2012 | Inagaki |
| 8,302,611 | B2 | 11/2012 | Rowley |
| 8,528,567 | B2 | 9/2013 | Hajaligol |
| 8,616,217 | B2 | 12/2013 | Tsurizumi et al. |
| 8,776,803 | B2 | 7/2014 | Tarora et al. |
| 8,863,754 | B2 | 10/2014 | Renaud et al. |
| 8,915,255 | B2 | 12/2014 | Poget et al. |
| 9,078,473 | B2 | 7/2015 | Worm et al. |
| 9,149,072 | B2 | 10/2015 | Conner et al. |
| 9,220,301 | B2 | 12/2015 | Banerjee et al. |
| 9,282,769 | B2 | 3/2016 | Mishra et al. |
| 9,301,546 | B2 | 4/2016 | Thomas et al. |
| 9,332,784 | B2 | 5/2016 | Banerjee et al. |
| 9,439,453 | B2 | 9/2016 | Conner et al. |
| 9,532,591 | B2 | 1/2017 | Mironov |
| 9,549,572 | B2 | 1/2017 | Dincer et al. |
| 9,609,893 | B2 | 4/2017 | Novak, III et al. |
| 9,629,393 | B2 | 4/2017 | Stolz et al. |
| 9,693,587 | B2 | 7/2017 | Plojoux |
| 9,717,273 | B2 | 8/2017 | Poget et al. |
| 9,730,468 | B2 | 8/2017 | Poget et al. |
| 9,801,412 | B2 | 10/2017 | Grant |
| 9,894,930 | B2 | 2/2018 | Bonici et al. |
| 9,918,494 | B2 | 3/2018 | Mironov et al. |
| 9,930,915 | B2 | 4/2018 | Worm et al. |
| 9,943,114 | B2 | 4/2018 | Batista |
| 9,961,939 | B2 | 5/2018 | Reevell |
| 10,034,493 | B2 | 7/2018 | Akiyama et al. |
| 10,064,428 | B2 | 9/2018 | Swepston et al. |
| 10,064,478 | B2 | 9/2018 | Brooks |
| 10,111,463 | B2 | 10/2018 | Batista |
| 10,159,277 | B2 | 12/2018 | Bonnely |
| 10,212,968 | B2 | 2/2019 | Mironov et al. |
| 10,231,484 | B2 | 3/2019 | Bowen et al. |
| 10,398,168 | B2 | 9/2019 | Maiwald et al. |
| 10,470,491 | B2 | 11/2019 | Sutton et al. |
| 10,492,526 | B2 | 12/2019 | Sampson et al. |
| 10,524,503 | B2 | 1/2020 | Florack et al. |
| 10,827,780 | B2 | 11/2020 | Swepston et al. |
| 2008/0047570 | A1 | 2/2008 | Plank |
| 2009/0065011 | A1 | 3/2009 | Maeder et al. |
| 2011/0083674 | A1 | 4/2011 | Karpinsky |
| 2013/0133675 | A1 | 5/2013 | Shinozaki et al. |
| 2013/0167850 | A1 | 7/2013 | Al-Aawar |
| 2013/0228190 | A1 | 9/2013 | Weiss et al. |
| 2014/0048085 | A1 | 2/2014 | Cox |
| 2014/0261487 | A1* | 9/2014 | Chapman ..... A24F 40/42 87/6 |
| 2015/0034100 | A1 | 2/2015 | Park et al. |
| 2015/0040924 | A1 | 2/2015 | Mironov et al. |
| 2015/0296882 | A1 | 10/2015 | Mironov et al. |
| 2015/0342254 | A1 | 12/2015 | Mironov et al. |
| 2016/0007648 | A1 | 1/2016 | Sutton et al. |
| 2016/0007649 | A1 | 1/2016 | Sampson et al. |
| 2016/0120216 | A1 | 5/2016 | Mironov et al. |
| 2016/0135495 | A1 | 5/2016 | Poget et al. |
| 2016/0174609 | A1 | 6/2016 | Mironov |
| 2016/0192704 | A1 | 7/2016 | Bonnely |
| 2016/0316816 | A1 | 11/2016 | Lavanchy et al. |
| 2016/0360785 | A1 | 12/2016 | Bless et al. |
| 2017/0000189 | A1 | 1/2017 | Mironov et al. |
| 2017/0055577 | A1 | 3/2017 | Batista |
| 2017/0055578 | A1 | 3/2017 | Oda et al. |
| 2017/0164654 | A1 | 6/2017 | Ademe |
| 2017/0196261 | A1 | 7/2017 | Borges De Couraca et al. |
| 2017/0303585 | A1 | 10/2017 | Florack et al. |
| 2017/0318859 | A1 | 11/2017 | Batista |
| 2018/0000165 | A1 | 1/2018 | Liu |
| 2018/0014571 | A1 | 1/2018 | Nakano |
| 2018/0070640 | A1 | 3/2018 | Bessant et al. |
| 2018/0116280 | A1 | 5/2018 | Maiwald et al. |
| 2018/0192707 | A1 | 7/2018 | Worm et al. |
| 2018/0317560 | A1 | 11/2018 | Shinozaki et al. |
| 2018/0325167 | A1 | 11/2018 | Grant |
| 2018/0368468 | A1 | 12/2018 | Mishra et al. |
| 2019/0000135 | A1 | 1/2019 | Lavanant et al. |
| 2019/0000141 | A1 | 1/2019 | Rojo-Calderon et al. |
| 2019/0000142 | A1 | 1/2019 | Lavanchy et al. |
| 2019/0014818 | A1 | 1/2019 | Saygili |
| 2019/0014820 | A1 | 1/2019 | Malgat |
| 2019/0014821 | A1 | 1/2019 | Batista et al. |
| 2019/0059449 | A1 | 2/2019 | Akiyama et al. |
| 2019/0059450 | A1 | 2/2019 | Akiyama et al. |
| 2019/0075848 | A1 | 3/2019 | Worm et al. |
| 2019/0124972 | A1 | 5/2019 | Nakano |
| 2019/0124973 | A1 | 5/2019 | Nakano et al. |
| 2019/0133176 | A1 | 5/2019 | Nakano et al. |
| 2019/0150505 | A1 | 5/2019 | Ceppi et al. |
| 2019/0274358 | A1 | 9/2019 | Reevell |
| 2020/0015519 | A1 | 1/2020 | Conner et al. |
| 2020/0060333 | A1 | 2/2020 | Sutton et al. |
| 2020/0146349 | A1 | 5/2020 | Phillips et al. |
| 2020/0268044 | A1 | 8/2020 | Wilson |
| 2021/0015172 | A1 | 1/2021 | Conner et al. |
| 2021/0015174 | A1 | 1/2021 | Cox et al. |
| 2021/0015175 | A1 | 1/2021 | Jackson et al. |

FOREIGN PATENT DOCUMENTS

| | | | |
|---|---|---|---|
| RU | 2614615 | C2 | 3/2017 |
| RU | 2675086 | C2 | 12/2018 |
| RU | 2683656 | C2 | 4/2019 |
| RU | 2685029 | C2 | 4/2019 |
| WO | WO1995034226 | | 12/1995 |
| WO | WO1998054989 | | 12/1998 |
| WO | WO2009022232 | | 2/2009 |
| WO | WO2013072336 | | 5/2013 |
| WO | 2013083963 | A1 | 6/2013 |
| WO | WO2013149810 | | 10/2013 |
| WO | WO2013189836 | | 12/2013 |
| WO | WO2014037270 | | 3/2014 |
| WO | 2014/159982 | A1 | 10/2014 |
| WO | WO2014156838 | | 10/2014 |
| WO | 2014180893 | A1 | 11/2014 |
| WO | 2015/101595 | A1 | 7/2015 |

(56) References Cited

FOREIGN PATENT DOCUMENTS

| | | | |
|---|---|---|---|
| WO | WO2015097005 | | 7/2015 |
| WO | WO2015128384 | | 9/2015 |
| WO | WO2015151158 | | 10/2015 |
| WO | 2015/197852 | A2 | 12/2015 |
| WO | WO2015184744 | | 12/2015 |
| WO | WO2015197850 | | 12/2015 |
| WO | WO2017042297 | | 3/2017 |
| WO | WO2017108912 | | 6/2017 |
| WO | WO2017114760 | | 7/2017 |
| WO | WO2017115181 | | 7/2017 |
| WO | WO2017115182 | | 7/2017 |
| WO | WO2017115183 | | 7/2017 |
| WO | WO2017115184 | | 7/2017 |
| WO | WO2017115185 | | 7/2017 |
| WO | WO2017115188 | | 7/2017 |
| WO | WO2017115196 | | 7/2017 |
| WO | WO2017207442 | | 12/2017 |
| WO | WO2017212284 | | 12/2017 |
| WO | 2018114441 | A1 | 6/2018 |
| WO | WO2018170800 | | 9/2018 |
| WO | WO2018201655 | | 11/2018 |
| WO | 2018/229086 | A1 | 12/2018 |
| WO | WO2019010680 | | 1/2019 |
| WO | 2019/030360 | A1 | 2/2019 |
| WO | 2020216762 | A1 | 10/2020 |

OTHER PUBLICATIONS

Stephenson, "A 'Safer' Cigarette? Prove It, Say Critics", JAMA, 2000, 283(19), pp. 2507-2508. doi:10.1001/jama.283.19.2507.

"Chemical and Biological Studies on New Cigarette Prototypes That Heat Instead of Burn Tobacco", R. J. Reynolds Tobacco Company, 1988.

* cited by examiner

AEROSOL DELIVERY DEVICE WITH SEPARABLE HEAT SOURCE AND SUBSTRATE

FIELD OF THE DISCLOSURE

The present disclosure relates to aerosol delivery devices and systems, such as smoking articles; and more particularly, to aerosol delivery devices and systems that utilize heat sources, such as combustible carbon-based ignition sources, for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles are made or derived from tobacco, or those articles can be characterized as otherwise incorporating tobacco for human consumption, and which are capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In addition, it would be desirable to provide a smoking article that is easy to use and that provides reusable components.

BRIEF SUMMARY

The present disclosure relates to aerosol delivery devices and cartridges for use with aerosol delivery devices. In one implementation, an aerosol delivery device may comprise a holder, a heat portion including a heat source configured to generate heat, and a substrate portion comprising a substrate material including an aerosol precursor composition. The holder may be configured to receive the heat portion and the substrate portion, the heat portion and the substrate portion may be disposed proximate each other, and the heat portion and the substrate portion may be separate components and may be configured to be independently removable and replaceable within the holder. In some implementations, the heat portion and the substrate portion may be disposed in an end-to-end arrangement. In some implementations, the heat portion and the substrate portion may be disposed in a side-by-side arrangement. In some implementations, a longitudinal axis of the heat portion may have an offset angle with respect to a longitudinal axis of the substrate portion. In some implementations, the heat portion and the substrate portion may be disposed in an over-under arrangement. In some implementations, the heat portion and the substrate portion may be in contact with each other. In some implementations, a space may exist between the heat portion and the substrate portion.

Some implementations may further comprise a heat transfer component disposed between the heat portion and the substrate portion. In some implementations, the heat transfer component may be configured to be independently removable and replacement within the holder. In some implementations, the heat transfer component may be integral with one or more of the heat portion or substrate portion. In some implementations, the substrate portion may include an outer housing surrounding at least a portion of the substrate material. In some implementations, the heat portion may include an outer housing surrounding at least a portion of the heat source. In some implementations, the holder may include a heat portion compartment. In some implementations, the holder may include a substrate portion compartment. In some implementations, the holder may include a heat portion compartment and a separate substrate portion compartment.

These and other features, aspects, and advantages of the disclosure will be apparent from a reading of the following detailed description together with the accompanying drawings, which are briefly described below.

BRIEF DESCRIPTION OF THE DRAWINGS

Figure 1:
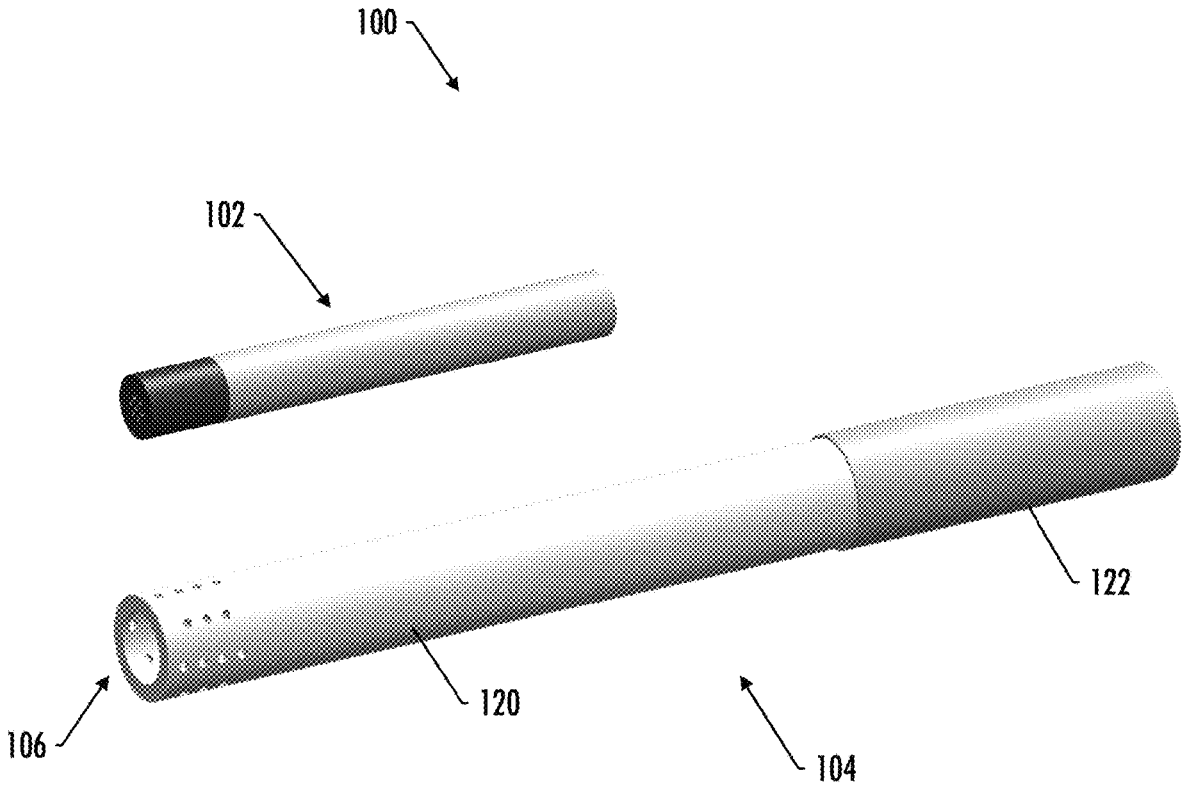
Figure 2:
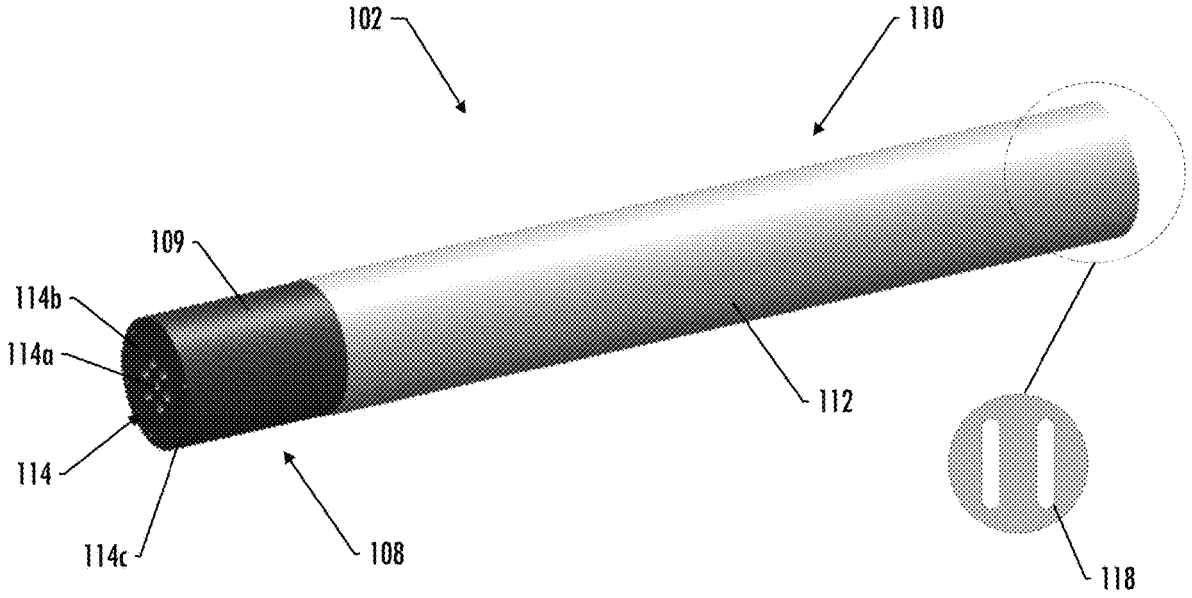
Figure 3:
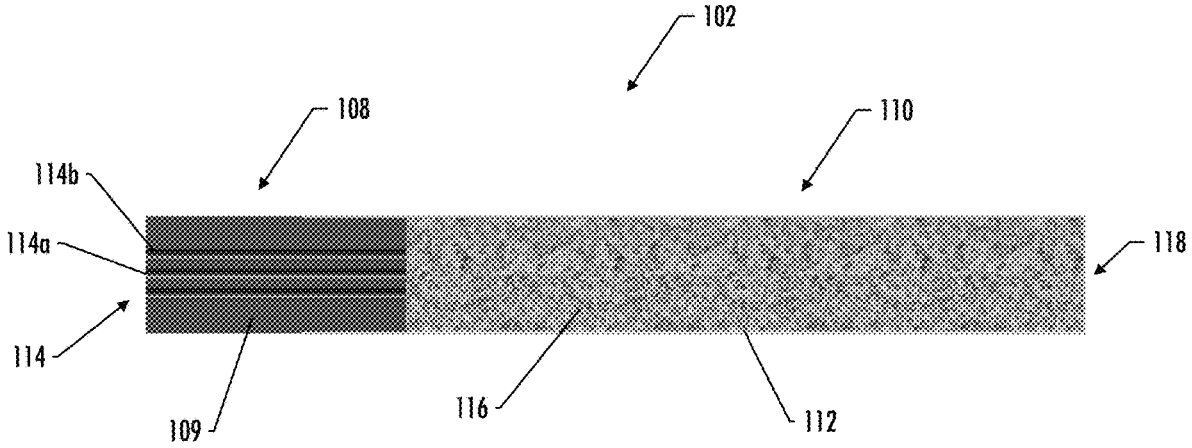
Figure 4:
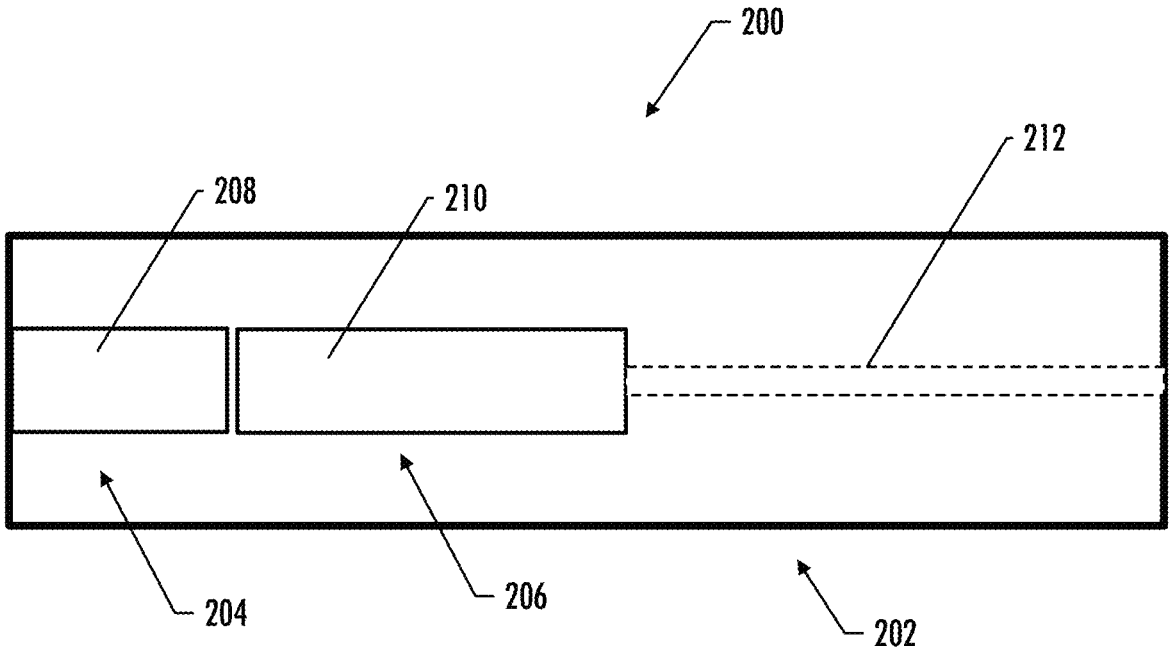
Figure 5:
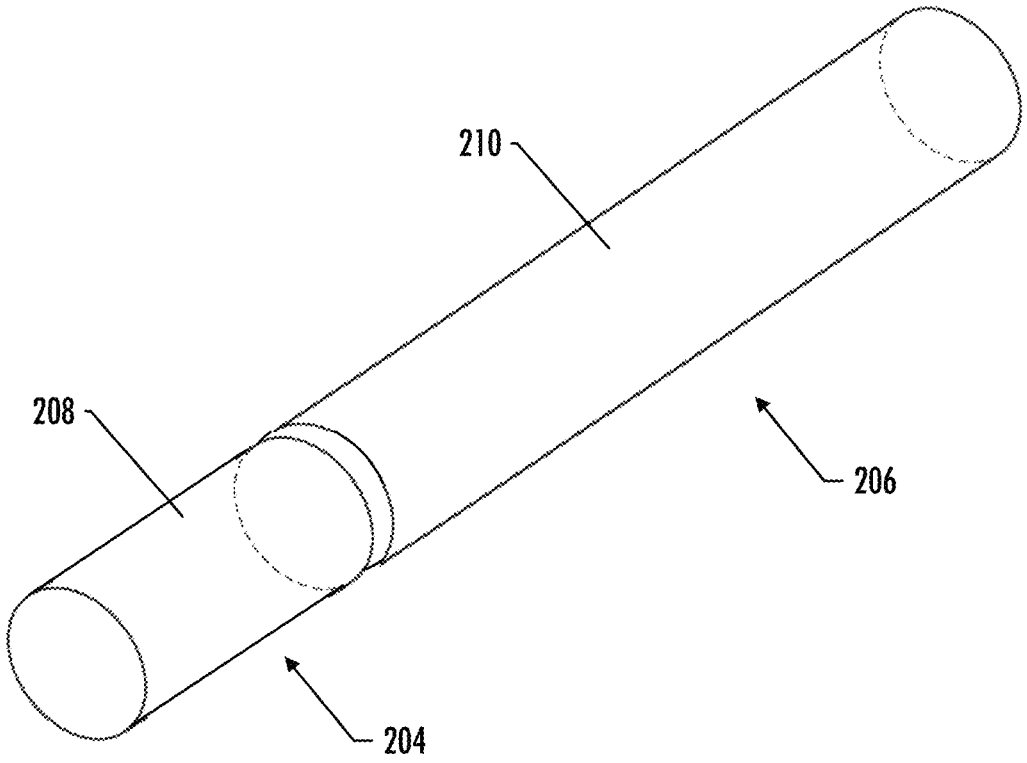
Figure 6:
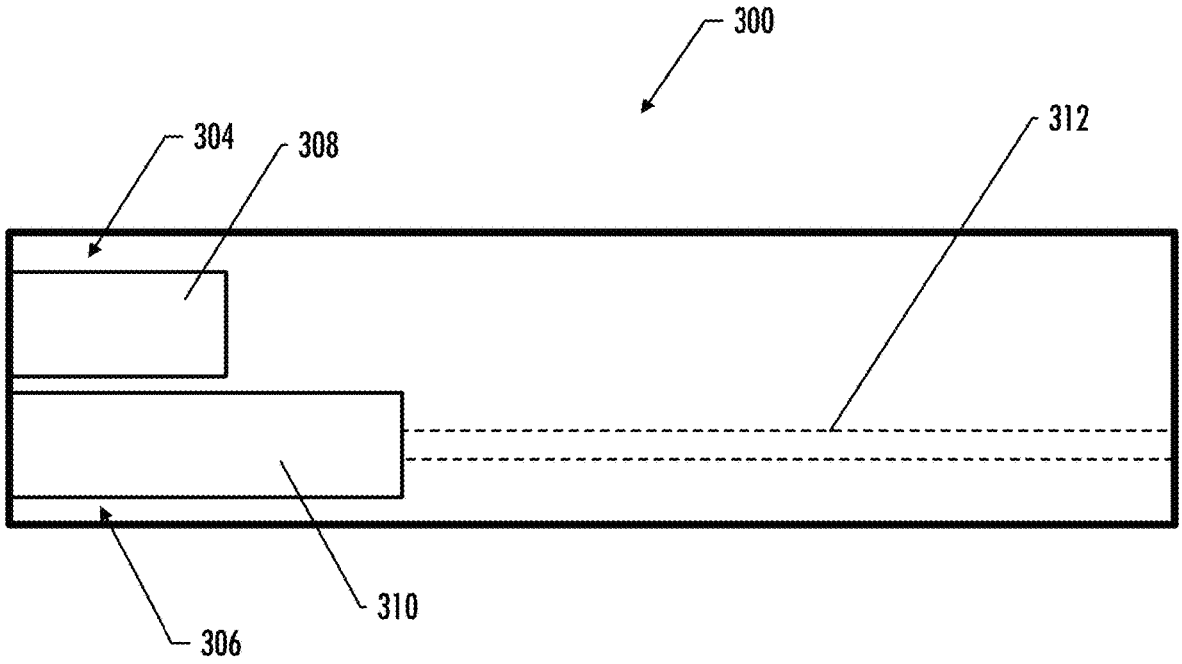
Figure 7:
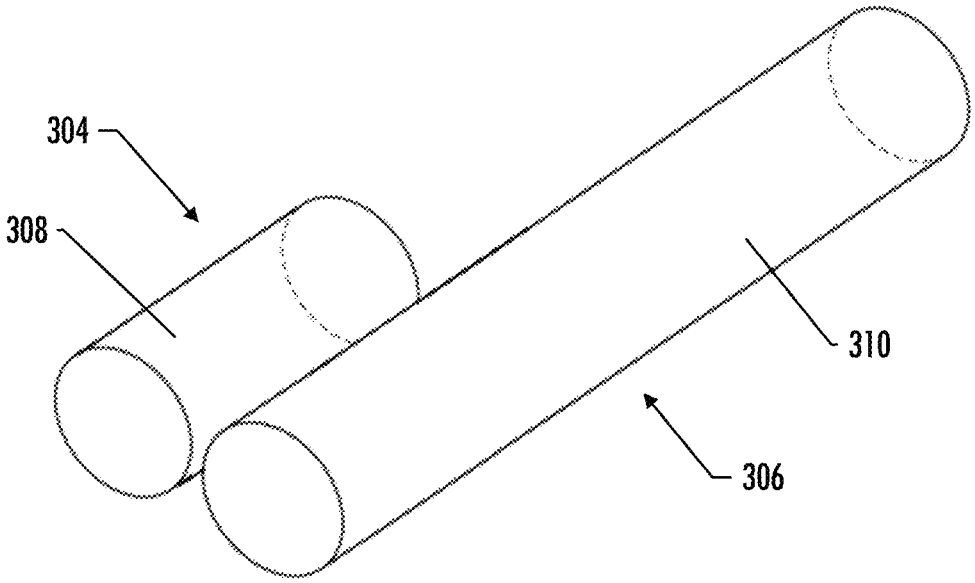
Figure 8:
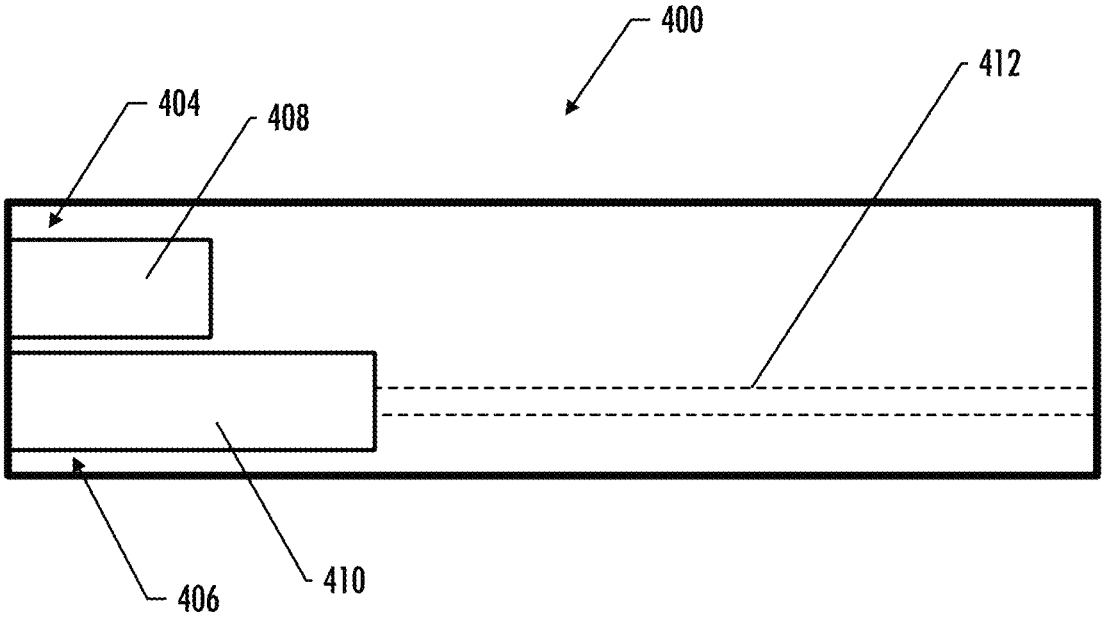
Figure 9:
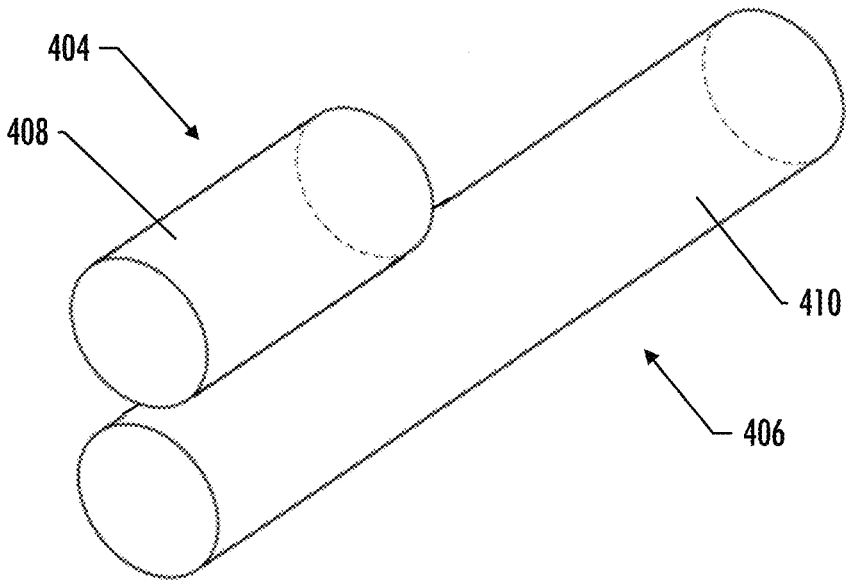
Figure 10:
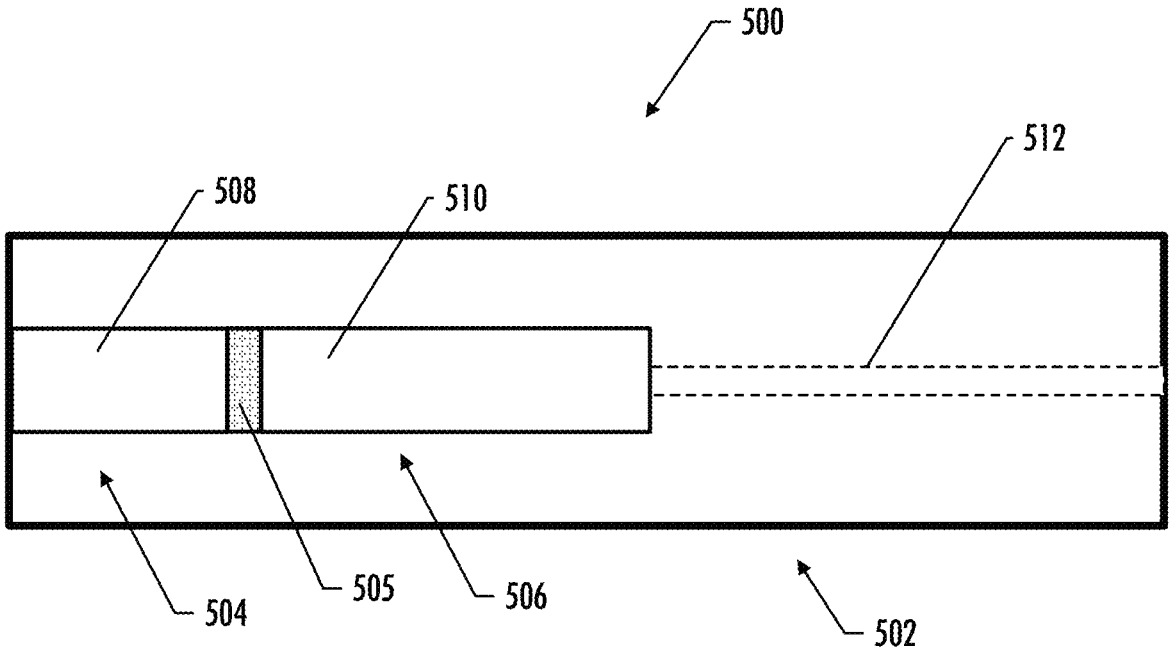

Having thus described the disclosure in the foregoing general terms, reference will now be made to the accompanying drawings, which are not necessarily drawn to scale, and wherein:

FIG. 1 illustrates a perspective view of an aerosol delivery device that includes a holder and a removable cartridge, according to one implementation of the present disclosure;

FIG. 2 illustrates a perspective view of a cartridge, according to one implementation of the present disclosure;

FIG. 3 illustrates a longitudinal cross-section view of the cartridge of FIG. 2, according to one implementation of the present disclosure;

FIG. 4 illustrates a top schematic view of an aerosol delivery device, according to one implementation of the present disclosure;

FIG. 5 illustrates a perspective schematic view of a separable heat portion and substrate portion, according to one implementation of the present disclosure;

FIG. 6 illustrates a top schematic view of an aerosol delivery device, according to one implementation of the present disclosure;

FIG. 7 illustrates a perspective schematic view of a separable heat portion and substrate portion, according to one implementation of the present disclosure;

FIG. 8 illustrates a front schematic view of an aerosol delivery device, according to one implementation of the present disclosure;

FIG. 9 illustrates a perspective schematic view of a separable heat portion and substrate portion, according to one implementation of the present disclosure; and FIG. 10 illustrates a top schematic view of an aerosol delivery device, according to one implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In preferred aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In preferred aspects, articles or devices characterized as smoking articles incorporate tobacco and/or components derived from tobacco.

As noted, aerosol generating components of certain preferred aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that component much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Smoking articles of the present disclosure generally include a number of elements provided or contained within an enclosure of some sort, such as a housing, an outer wrap, or wrapping, a casing, a component, a module, a member, or the like. The overall design of the enclosure is variable, and the format or configuration of the enclosure that defines the overall size and shape of the smoking article is also variable. In some, but not all implementations, the overall design, size, and/or shape of the enclosure resembles that of a conventional cigarette or cigar. Typically, an enclosure resembling the shape of a cigarette or cigar comprises separable components, members, or the like that are engaged to form the enclosure. For example, such a smoking article may comprise, in some aspects, separable components that include a holder and a cartridge that includes an aerosol delivery component (such as, for example, a substrate material) and a heat source component. In various aspects, the heat source may be capable of generating heat to aerosolize a substrate material that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. In some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations aerosol precursor composition-loaded porous beads/powders (ceramics) may be used. In other implementations, rods/cylinders made of extruded slurry of ceramic powder and aerosol precursor composition may be used.

According to certain aspects of the present disclosure, it may be advantageous to provide a smoking article that is easy to use and that provides reusable components. FIG. 1 illustrates a perspective view of such a smoking article, according to one implementation of the present disclosure. In particular, FIG. 1 illustrates a perspective view of a smoking article 100 that includes a removable cartridge 102 and a holder 104. The holder 104 includes a main body portion 120 and a mouthpiece portion 122 located at a mouth end of the holder 104. Although various implementations of holders may differ in the structure and manner in which a removable cartridge of the present disclosure is received, in the depicted implementation the removable cartridge 102 is configured to be longitudinally removably received into a cavity 106 defined on a receiving end of the main body portion 120 of the holder 104. Some examples of one or more holders that may be used in in conjunction with the removable cartridges of the present disclosure are described in U.S. patent application Ser. No. 16/035,103, filed on Jul. 13, 2018, and titled Smoking Article with Detachable Cartridge, which is incorporated herein by reference in its entirety.

In various implementations, the heat portions and substrate portions of the present disclosure may be used in a variety of different holders. Some examples are holders that may be used with the present disclosure are included in U.S. patent application Ser. No. 16/516,573, filed on Jul. 19, 2019, and titled Holder for Aerosol Delivery Device with Detachable Cartridge; U.S. patent application Ser. No. 16/516,601, filed on Jul. 19, 2019, and titled Aerosol Delivery Device with Sliding Sleeve; U.S. patent application Ser. No. 16/516,621, filed on Jul. 19, 2019, and titled Aerosol Delivery Device with Clamshell Holder for Cartridge; and U.S. patent application Ser. No. 16/516,821, filed on July 19, and titled Aerosol Delivery Device with Rotatable Enclosure for Cartridge, each of which is incorporated herein by reference in its entirety.

FIG. 2 illustrates a perspective view of the removable cartridge 102 of FIG. 1, according to an example implementation of the present disclosure. In the depicted implementation, the removable cartridge 102 includes a heat portion 108 comprising a heat source 109, a substrate portion 110 comprising a substrate material 116 (see FIG. 3), and an outer housing 112 configured to circumscribe at least a portion of the heat source 109 and substrate material 116. It should be noted that although in the depicted implementation the cartridge 102 and the holder 104 have substantially cylindrical overall shapes, in various other implementations, any one or both of these components (and/or any of their subcomponents, such as, for example, the main body portion and/or the mouthpiece portion, of the holder, and/or the heat source, the outer housing, and/or the substrate material of the cartridge, may have a different shape. For example, in some implementations one or both of the holder or the cartridge (and/or any of their subcomponents) may have a substantially rectangular shape, such as a substantially rectangular cuboid shape. In other implementations, one or both of the holder or the cartridge (and/or any of their subcomponents) may have other hand-held shapes. For example, in some implementations the holder may have a small box shape, various pod mod shapes, or a fob-shape. Some examples of cartridge configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety.

In various implementations, the heat source may be configured to generate heat upon ignition thereof. In the depicted implementation, the heat source 109 comprises a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible.

Although specific dimensions of an applicable heat source may vary, in the depicted implementation, the heat source 109 has a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source 109 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Although in various implementations the heat source may have a variety of forms, including, for example, a substantially solid cylindrical shape or a hollow cylindrical (e.g., tube) shape, the heat source 109 of the depicted implementation comprises an extruded monolithic carbonaceous material that has a generally cylindrical shape that includes a plurality of internal passages 114 extending longitudinally from a first end of the heat source 109 to an opposing second end of the heat source 109. In the depicted implementation there are approximately thirteen internal passages 114 comprising a single central internal passage 114*a*, six surrounding internal passages 114*b*, which are spaced from the central internal passages 114*a* and have a similar size (e.g., diameter) to that of the central internal passage 114*a*, and six peripheral internal passages 114*c*, which are spaced from an outer surface of the heat source 109 and are smaller in diameter than that of the central internal passage 114*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Although not depicted in the figures, some implementations may alternatively, or additionally, include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 3 illustrates a longitudinal cross-section view of the cartridge 102 of FIG. 1. As shown in the figure, the substrate material 116 of the depicted implementation has opposed first and second ends, with the heat source 109 disposed adjacent the first end of the substrate material 116. Although dimensions of the various components of the cartridge may vary due to the needs of a particular application, in the depicted implementation the cartridge 102 may have an overall length in an inclusive range of approximately 10 mm to approximately 50 mm and a diameter in an inclusive range of approximately 2 mm to approximately 20 mm. In addition, in the depicted implementation the housing 112 may have a thickness in the inclusive range of approximately 0.05 mm to 0.5 mm. Furthermore, in the depicted implementation the substrate material 116 may have a length in the inclusive range of approximately 5 mm to 50 mm and a diameter slightly less than that of the overall cartridge in order to accommodate the thickness of the housing 112, such as, for example, a diameter in an inclusive range of approximately 2.9 mm to approximately 9.9 mm.

In the depicted implementation, the substrate portion 110 comprises a substrate material 116 having a single segment, although in other implementations the substrate portion may include one or more additional substrate material segments. For example in some implementations, the smoking article 100 may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 116 of the depicted implementation).

Referring also to FIG. 1, ignition of the heat source 109 of the depicted implementation results in aerosolization of the aerosol precursor composition associated with the substrate material 116. In various implementations, the mouthpiece portion 122 is configured to receive the generated aerosol therethrough in response to a draw applied to the mouthpiece portion 122 by a user. In some implementations the mouthpiece portion 122 may comprise a filter configured to receive the aerosol therethrough in response to the draw applied to the mouthpiece portion 122. In various implementations, the filter may be provided, in some aspects, as a circular disc radially and/or longitudinally disposed proximate the end of the holder opposite the receiving end. In this manner, upon a draw on the mouthpiece portion 122, the filter may receive the aerosol flowing through holder 104 of the smoking article 100. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the smoking article 100 of the depicted implementation, the substrate material 116 comprises a plurality of tobacco beads together formed into a substantially cylindrical portion. In various implementations, however, the substrate material may comprise a variety of different compositions and combinations thereof, as explained in more detail below.

In one implementation, for example, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. patent application Ser. No. 15/905,320, filed on Feb. 26, 2018, and titled Heat Conducting Substrate For Electrically Heated Aerosol Delivery Device, which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., *Fund. Appl. Toxicol.,* 39, p. 11-17 (1997); the disclosures of which are incorporated herein by reference in their entireties.

In still other implementations of the present disclosure, the substrate material may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may include an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally or alternatively, the substrate material may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as an aerosol precursor composition, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

In some implementations, the substrate material may comprise a liquid including an aerosol precursor composition and/or a gel including an aerosol precursor composition. Some examples of liquid compositions can be found in U.S. patent application Ser. No. 16/171,920, filed on Oct. 26, 2018, and titled Aerosol Delivery Device With Visible Indicator, which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The aerosol may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally or alternatively include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)).

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

In the depicted implementation, the substrate material 116 may comprise a centrally defined longitudinally extending axis between the opposed first and second ends, and a cross-section of the substrate material 116 may be, in some implementations, symmetrical about the axis. For example, in some implementations a cross-section of the substrate material 116 may be substantially circular such that the substrate material 116 defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

As shown in FIGS. 2 and 3, the cartridge 102 of the depicted implementation also includes an outer housing 112 configured to circumscribe at least a portion of the substrate portion 110, including the substrate material 116. In the depicted implementation, the outer housing 112 is also configured to circumscribe at least a portion of the heat source 109. In the depicted implementation, the outer housing comprises a rigid material. For example, the outer housing 112 of the depicted implementation is constructed of an aluminum material; however, in other implementations the outer housing 112 may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. Pat. App. Ser. No. 16/174,846, filed on Oct. 30, 2018, and titled Smoking Article Cartridge, which is incorporated herein by reference in its entirety.

In the depicted implementation, the outer housing 112 is constructed as tube structure that substantially encapsulates the substrate material 116; however, as noted above, in other implementations the outer housing 112 may have other shapes. Although the shape of the outer housing 112 may vary, in the depicted implementation the outer housing 112 comprises a tube structure having an open end and a closed end. The depicted implementation of the outer housing 112 also includes one or more end apertures 118 located on the closed end of the outer housing 112 that are configured to allow aerosolized vapor (herein alternatively referred to as a "vapor" or "aerosol") to pass therethrough. The end apertures 118 of the depicted implementation are in the form of a pair of elongate rounded slots; however, in other implementations the end apertures may have any form that permits passage of the aerosol therethrough. As such, it will be appreciated that the end apertures 118 can comprise fewer or additional apertures and/or alternative shapes and sizes of apertures than those illustrated.

Although the heat portion 108 and the substrate portion 110 of the implementation of FIGS. 1-3 are contained together and circumscribed by the outer housing forming a unitary cartridge, in implementations of the present disclosure, the heat portion and the substrate portion comprise separate components and are configured to be independently removable and replaceable within a holder. In such a manner, a user may remove and/or replace only the heat portion, or only the substrate portion, or both the heat portion and the substrate portion. For example, FIG. 4 illustrates a top schematic view of an aerosol delivery device, according to one implementation of the present disclosure. In particular, FIG. 4 illustrates a top schematic view of an aerosol delivery device 200. In the depicted implementation, the aerosol delivery device 200 includes a holder 202, which is configured to receive a heat portion 204 and, separately, a substrate portion 206. In the depicted implementation, the heat portion 204 includes a heat source 208, and the substrate portion 206 includes a substrate material 210. The aerosol delivery device 200 of the depicted implementation further includes an aerosol passage 212, which extends from the substrate portion 210 through the holder 202.

In some implementations, the heat portion may include an outer housing configured to circumscribe or enclose at least a portion of the heat source. Likewise, the substrate portion of some implementations may include an outer housing configured to circumscribe or enclose at least a portion of the substrate material. It should be noted, however, that in other implementations one or both of the heat source or the substrate material may not be circumscribed by an outer housing such that the heat source and/or the substrate material are bare. In some implementations, the holder may further include a heat portion compartment, configured to receive the heat portion, and/or a substrate portion compartment, configured to receive the substrate portion. It should be noted that possible heat sources and/or possible substrate materials of the depicted implementation are similar to those described above. As such, reference is made to the pertinent discussions of these characteristics (and variations thereof), which will not be repeated here.

In the depicted implementation, the heat portion 204 and the substrate portion 210 are substantially longitudinally aligned in an end-to-end arrangement. FIG. 5 illustrates a perspective schematic view of the heat portion 204 and the substrate portion 206 of the implementation of FIG. 5. In the depicted implementation, a proximal end of the heat source 208 of the depicted implementation is positioned proximate a distal end of the substrate material 210. In some implementations, the heat portion and the substrate portion may contact each other. In other implementations, a space may exist between the heat portion and the substrate portion. In some implementations a barrier may be located between the heat portion and the substrate portion. In some implementations, the barrier may be substantially porous, while in other implementations the barrier may be substantially non-porous. For example, reference is made to the implementation described below with respect to FIG. 10. In some implementations, a barrier may prevent or inhibit combustion gasses from being drawn through the substrate material (and/or from being drawn through air passageways through which aerosol is drawn).

In some implementations, a heat transfer component, which may or may not comprise a barrier, may be located between the heat source and the substrate material. In various implementations, the heat transfer component can be any material or combination of materials configured to transfer heat from the heat source to the substrate material. For example, in some implementations the heat transfer component may comprise one or more conductive materials, including, for example, gold, silver, copper, aluminum, stainless steel, etc., as well as combinations of these materials and laminates containing one or more of these materials. In some implementations, the heat transfer component is configured to be independently removable and replacement within the holder. In other implementations, the heat transfer component may be integral with one or more of the heat portion or substrate portion. In some embodiments the heat transfer component may form part of a non-porous barrier, which may prevent or inhibit combustion gasses from being drawn through substrate (or drawn through air passageway through which aerosol is drawn). In some implementations, the holder or a portion of the holder (such as a receiving chamber) may be heat conductive and may be in intimate contact with a heat transfer component and/or the substrate material.

In the depicted implementation, ignition of the heat source 208 results in aerosolization of the aerosol precursor composition associated with the substrate material 210. In the depicted implementation, the aerosol passage 212 of the holder 200 is configured to receive the generated aerosol therethrough in response to a draw applied to the holder 202 by a user. Although not shown, in some implementations the holder may include one or more air inlet openings that extend through the holder proximate the substrate portion. Additionally or alternatively, other implementations may include one or more air inlet openings that extend through the holder downstream from the substrate portion. In such a manner, drawn air may mix with the generated aerosol before being delivered to the user.

Another example implementation is shown in FIG. 6, which illustrates a top schematic view of an aerosol delivery device. In particular, FIG. 6 illustrates a top schematic view of an aerosol delivery device 300. In the depicted implementation, the aerosol delivery device 300 includes a holder 302, which is configured to receive a heat portion 304 and, separately, a substrate portion 306. In the depicted implementation, the heat portion 304 includes a heat source 308, and the substrate portion 306 includes a substrate material 310. The aerosol delivery device 300 of the depicted implementation further includes an aerosol passage 312, which extends from the substrate portion 310 through the holder 302.

In some implementations, the heat portion may include an outer housing configured to circumscribe or enclose at least a portion of the heat source. Likewise, the substrate portion of some implementations may include an outer housing configured to circumscribe or enclose at least a portion of the substrate material. It should be noted, however, that in other implementations one or both of the heat source or the substrate material may not be circumscribed by an outer housing such that the heat source and/or the substrate material are bare. In some implementations, the holder may further include a heat portion compartment, configured to receive the heat portion, and/or a substrate portion compartment, configured to receive the substrate portion. It should be noted that possible heat sources and/or possible substrate materials of the depicted implementation are similar to those described above. As such, reference is made to the pertinent discussions of these characteristics (and variations thereof), which will not be repeated here.

In the depicted implementation, the heat portion 304 and the substrate portion 310 are transversely aligned in a side-to-side arrangement (with respect to a top of the device 300). FIG. 7 illustrates a perspective schematic view of the heat portion 304 and substrate portion 306 of the implementation of FIG. 6. In the depicted implementation, a distal end of the heat source 308 is positioned proximate a distal end of the substrate material 310. It should be noted that in other implementations, the heat source may be located at any location next to the substrate material. For example, in some implementations the heat source may be transversely aligned in a side-to-side arrangement (with respect to the top of the device) with the heat source being located between the distal end and the first end of the substrate material. In other implementations, the first end of the heat source may substantially align with a first end of the substrate material.

In some implementations, the heat portion and the substrate portion may contact each other. In other implementations, a space may exist between the heat portion and the substrate portion. In some implementations a barrier may be located between the heat portion and the substrate portion. In some implementations, the barrier may be substantially porous, while in other implementations the barrier may be substantially non-porous. For example, reference is made to the implementation described below with respect to FIG. 10. In some implementations, a barrier may prevent or inhibit combustion gasses from being drawn through the substrate material (and/or from being drawn through air passageways through which aerosol is drawn).

In some implementations, a heat transfer component may be located between the heat source and the substrate material. In various implementations, the heat transfer component can be any material or combination of materials configured to transfer heat from the heat source to the substrate material. For example, in some implementations the heat transfer component may comprise one or more conductive materials, including, for example, gold, silver, copper, aluminum, stainless steel, etc., as well as combinations of these materials and laminates containing one or more of these materials. In some implementations, the heat transfer component is configured to be independently removable and replacement within the holder. In other implementations, the heat transfer component may be integral with one or more of the heat portion or substrate portion. In some embodiments the heat transfer component may form part of a non-porous barrier, which may prevent or inhibit combustion gasses from being drawn through substrate (or drawn through air passageway through which aerosol is drawn). In some implementations, the holder or a portion of the holder (such as a receiving chamber) may be heat conductive and may be in intimate contact with a heat transfer component and/or the substrate material.

In the depicted implementation, ignition of the heat source 308 results in aerosolization of the aerosol precursor composition associated with the substrate material 310. In the depicted implementation, the aerosol passage 312 of the holder 302 is configured to receive the generated aerosol therethrough in response to a draw applied to the holder 302 by a user. Although not shown, in some implementations the holder may include one or more air inlet openings that extend through the holder proximate the substrate portion. Additionally or alternatively, other implementations may include one or more air inlet openings that extend through the holder downstream from the substrate portion. In such a manner, drawn air may mix with the generated aerosol before being delivered to the user.

Another example implementation is shown in FIG. 8, which illustrates a front schematic view of an aerosol delivery device. In particular, FIG. 8 illustrates a front schematic view of an aerosol delivery device 400. In the depicted implementation, the aerosol delivery device 400 includes a holder 402, which is configured to receive a heat portion 404 and, separately, a substrate portion 406. In the depicted implementation, the heat portion 404 includes a heat source 408, and the substrate portion 406 includes a substrate material 410. The aerosol delivery device 400 of the depicted implementation further includes an aerosol passage 412, which extends from the substrate portion 410 through the holder 402.

In some implementations, the heat portion may include an outer housing configured to circumscribe or enclose at least a portion of the heat source. Likewise, the substrate portion of some implementations may include an outer housing configured to circumscribe or enclose at least a portion of the substrate material. It should be noted, however, that in other implementations one or both of the heat source or the substrate material may not be circumscribed by an outer housing such that the heat source and/or the substrate material are bare. In some implementations, the holder may further include a heat portion compartment, configured to receive the heat portion, and/or a substrate portion compartment, configured to receive the substrate portion. It should be noted that possible heat sources and/or possible substrate materials of the depicted implementation are similar to those described above. As such, reference is made to the pertinent discussions of these characteristics (and variations thereof), which will not be repeated here.

In the depicted implementation, the heat portion 404 and the substrate portion 410 are aligned in an over-under arrangement (with respect to a top of the device 400). FIG. 9 illustrates a perspective schematic view of the heat portion 404 and substrate portion 406 of the depicted implementation of FIG. 8. In the depicted implementation, a distal end of the heat source 408 is positioned proximate and above a distal end of the substrate material 410. It should be noted that in other implementations, the heat source may be located at any location above or below to the substrate material. For example, in some implementations the heat source may be aligned in an over-under arrangement (with respect to the top of the device) with the heat source being located between the distal end and the first end of the substrate material. In other implementations, the first end of the heat source may substantially align with a first end of the substrate material.

In some implementations, the heat portion and the substrate portion may contact each other. In other implementations, a space may exist between the heat portion and the substrate portion. In some implementations a barrier may be located between the heat portion and the substrate portion. In some implementations, the barrier may be substantially porous, while in other implementations the barrier may be substantially non-porous. For example, reference is made to the implementation described below with respect to FIG. 10. In some implementations, a barrier may prevent or inhibit combustion gasses from being drawn through the substrate material (and/or from being drawn through air passageways through which aerosol is drawn).

In some implementations a heat transfer component may be located between the heat source and the substrate material. In various implementations, the heat transfer component can be any material or combination of materials configured to transfer heat from the heat source to the substrate material. For example, in some implementations the heat transfer component may comprise one or more conductive materials, including, for example, gold, silver, copper, aluminum, stainless steel, etc., as well as combinations of these materials and laminates containing one or more of these materials. In some implementations, the heat transfer component is configured to be independently removable and replacement within the holder. In other implementations, the heat transfer component may be integral with one or more of the heat portion or substrate portion. In some embodiments the heat transfer component may form part of a non-porous barrier, which may prevent or inhibit combustion gasses from being drawn through substrate (or drawn through air passageway through which aerosol is drawn). In some implementations, the holder or a portion of the holder (such as a receiving chamber) may be heat conductive and may be in intimate contact with a heat transfer component and/or the substrate material In the depicted implementation, ignition of the heat source 408 results in aerosolization of the aerosol precursor composition associated with the substrate material 410. In the depicted implementation, the aerosol passage 412 of the holder 402 is configured to receive the generated aerosol therethrough in response to a draw applied to the holder 402 by a user. Although not shown, in some implementations the holder may include one or more air inlet openings that extend through the holder proximate the substrate portion. Additionally or alternatively, other implementations may include one or more air inlet openings that extend through the holder downstream from the substrate portion. In such a manner, drawn air may mix with the generated aerosol before being delivered to the user.

FIG. 10 illustrates a top schematic view of an aerosol delivery device, according to one implementation of the present disclosure. In particular, FIG. 10 illustrates a top schematic view of an aerosol delivery device 500. In the depicted implementation, the aerosol delivery device 500 includes a holder 502, which is configured to receive a heat portion 504 and, separately, a substrate portion 506. In the depicted implementation, the heat portion 504 includes a heat source 508, and the substrate portion 506 includes a substrate material 510. The aerosol delivery device 500 of the depicted implementation further includes an aerosol passage 512, which extends from the substrate portion 510 through the holder 502.

In some implementations, the heat portion may include an outer housing configured to circumscribe or enclose at least a portion of the heat source. Likewise, the substrate portion of some implementations may include an outer housing configured to circumscribe or enclose at least a portion of the substrate material. It should be noted, however, that in other implementations one or both of the heat source or the substrate material may not be circumscribed by an outer housing such that the heat source and/or the substrate material are bare. In some implementations, the holder may further include a heat portion compartment, configured to receive the heat portion, and/or a substrate portion compartment, configured to receive the substrate portion. It should be noted that possible heat sources and/or possible substrate materials of the depicted implementation are similar to those described above. As such, reference is made to the pertinent discussions of these characteristics (and variations thereof), which will not be repeated here.

In the depicted implementation, the heat portion 504 and the substrate portion 510 are substantially longitudinally aligned in an end-to-end arrangement. In the depicted implementation, a barrier 505 is located between the heat source 508 and the substrate material 510. In the depicted implementation, the barrier 505 comprises a heat transfer component. In various implementations, the heat transfer component may be made of any material or combination of materials configured to transfer heat from the heat source to the substrate material. For example, in some implementations the heat transfer component may comprise one or more conductive materials, including, for example, gold, silver, copper, aluminum, stainless steel, etc., as well as combinations of these materials and laminates containing one or more of these materials. In some implementations, the heat transfer component is configured to be independently removable and replacement within the holder. In other implementations, the heat transfer component may be integral with one or more of the heat portion or substrate portion. Some examples of heat transfer components are described in U.S. patent application Ser. No. 15/923,735, filed on Mar. 16, 2018, and titled Smoking Article with Heat Transfer Component, which is incorporated herein by reference in its entirety.

In the depicted implementation, the heat source 508 and substrate material 510 contact opposite portions of the barrier 505; however, in other implementations one or both of the heat source or the substrate material may be spaced from the barrier. In some implementations, the barrier may be substantially porous, while in other implementations the barrier may be substantially non-porous. In some implementations, a heat transfer component may be located between the heat source and the substrate material.

In the depicted implementation, ignition of the heat source 508 results in aerosolization of the aerosol precursor composition associated with the substrate material 510. In the depicted implementation, the aerosol passage 512 of the holder 500 is configured to receive the generated aerosol therethrough in response to a draw applied to the holder 502 by a user. Although not shown, in some implementations the holder may include one or more air inlet openings that extend through the holder proximate the substrate portion. Additionally or alternatively, other implementations may include one or more air inlet openings that extend through the holder downstream from the substrate portion. In such a manner, drawn air may mix with the generated aerosol before being delivered to the user.

It should be noted that in the depicted implementations, a distal end of heat portion and an end of substrate portion are substantially aligned with each other; however, in other implementations this may not be the case. For example, in some implementations, a longitudinal axis of the heat portion may be located substantially parallel to a longitudinal axis of the substrate portion but the heat portion may be located between a proximate end and a distal end of the substrate portion. It should further be noted that although the depicted implementations illustrate a longitudinal axis of a heat portion that is either substantially aligned with or substantially parallel to a longitudinal axis of a substrate portion, in other implementations a longitudinal axis of the heat portion may not be substantially aligned with or substantially parallel to a longitudinal axis of the substrate portion. For example, in some implementations a longitudinal axis of the heat portion may have a non-zero degree angle with respect to a longitudinal axis of the substrate portion such as, for example, an offset angle (e.g., an acute angle, an obtuse angle, or a substantially perpendicular angle). In various implementations, such angles may be in the same plane or in different planes. Although an aerosol delivery device according to the disclosure may take on a variety of implementations, as discussed in detail herein, the use of the aerosol delivery device by a consumer will be similar in scope. The foregoing description of use of the aerosol delivery device is applicable to the various implementations described through minor modifications, which are apparent to the person of skill in the art in light of the further disclosure provided herein. The description of use, however, is not intended to limit the use of the inventive device but is provided to comply with all necessary requirements of disclosure herein.

Although in some implementations of the present disclosure a heat portion, a substrate portion, and a holder may be provided together as a complete aerosol delivery device generally, these components may be provided separately. For example, the present disclosure also encompasses disposable units for use with a reusable unit. In specific implementations, such disposable units (which may be one or more of a heat portion or a substrate portion, as illustrated in the appended figures) can be configured to engage a reusable unit (which may be a holder as illustrated in the appended figures). In still other configurations, one or more of a heat portion or a substrate portion may comprise a reusable unit and a holder may comprise a disposable unit.

Although some figures described herein illustrate a heat portion, a substrate portion, and a holder in a working relationship, it is understood that the heat portion and/or the substrate portion and/or the holder may exist as individual components. Accordingly, any discussion otherwise provided herein in relation to the components in combination also should be understood as applying to the holder and the cartridge as individual and separate components.

In another aspect, the present disclosure may be directed to kits that provide a variety of components as described herein. For example, a kit may comprise a holder with one or more heat portions and/or one or more substrate portions. In further implementations, a kit may comprise a plurality of heat portions and/or a plurality of substrate portions. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a receiving chamber of the holder, or, in other implementations, inserted in a separate aperture that enables a user to remove debris from the receiving chamber.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a holder;

a heat portion including a heat source configured to generate heat; and a substrate portion comprising a substrate material including an aerosol precursor composition, wherein the holder is configured to receive the heat portion and the substrate portion, wherein the heat portion and the substrate portion are disposed proximate each other, and wherein the heat portion and the substrate portion are separate components and are configured to be independently removable and replaceable within the holder.

2. The aerosol delivery device of claim 1, wherein the heat portion and the substrate portion are disposed in an end-to-end arrangement.

3. The aerosol delivery device of claim 1, wherein the heat portion and the substrate portion are disposed in a side-by-side arrangement.

4. The aerosol delivery device of claim 1, wherein a longitudinal axis of the heat portion has an offset angle with respect to a longitudinal axis of the substrate portion.

5. The aerosol delivery device of claim 1, wherein the heat portion and the substrate portion are disposed in an over-under arrangement.

6. The aerosol delivery device of claim 1, wherein the heat portion and the substrate portion are in contact with each other.

7. The aerosol delivery device of claim 1, wherein a space exists between the heat portion and the substrate portion.

8. The aerosol delivery device of claim 1 further comprising a heat transfer component disposed between the heat portion and the substrate portion.

9. The aerosol delivery device of claim 7, wherein the heat transfer component is configured to be independently removable and replacement within the holder.

10. The aerosol delivery device of claim 7, wherein the heat transfer component is integral with one or more of the heat portion or substrate portion.

11. The aerosol delivery device of claim 1, wherein the substrate portion includes an outer housing surrounding at least a portion of the substrate material.

12. The aerosol delivery device of claim 1, wherein the heat portion includes an outer housing surrounding at least a portion of the heat source.

13. The aerosol delivery device of claim 1, wherein the holder includes a heat portion compartment.

14. The aerosol delivery device of claim 1, wherein the holder includes a substrate portion compartment.

15. The aerosol delivery device of claim 1, wherein the holder includes a heat portion compartment and a separate substrate portion compartment.

* * * * *